United States Patent [19]

O'Brien et al.

[11] Patent Number: 4,909,499

[45] Date of Patent: Mar. 20, 1990

[54] MAIL SINGULATING APPARATUS

[75] Inventors: John J. O'Brien, Riverdale, N.Y.; Russell W. Holbrook, Ridgefield, Conn.

[73] Assignee: Pitney Bowes Inc., Stamford, Conn.

[21] Appl. No.: 291,098

[22] Filed: Dec. 28, 1988

[51] Int. Cl.[4] ..... B65H 3/04

[52] U.S. Cl. ..... 271/10; 271/35; 271/122; 271/263; 271/273

[58] Field of Search ..... 271/6, 10, 34, 117, 271/122, 124, 125, 202, 273, 274, 270, 263, 35

[56] References Cited

U.S. PATENT DOCUMENTS

| | | | |
|---|---|---|---|
| 3,108,801 | 10/1963 | Van Dalen . | |
| 3,272,500 | 9/1966 | Van Dalen et al. . | |
| 3,506,258 | 4/1970 | Lindquist . | |
| 3,532,338 | 10/1970 | Brinson et al. . | |
| 3,635,465 | 1/1972 | Beery | 271/122 |
| 3,734,490 | 5/1973 | Parks . | |
| 3,737,158 | 6/1973 | Beery et al. . | |
| 3,831,928 | 8/1974 | Davis . | |
| 3,878,025 | 4/1975 | Storace et al. . | |
| 3,933,350 | 1/1976 | Mignano . | |
| 3,947,022 | 3/1976 | Kockler . | |
| 3,964,739 | 6/1976 | Garcia . | |
| 3,970,298 | 7/1976 | Irvine et al. . | |
| 3,981,493 | 9/1976 | Klappenecker et al. . | |
| 3,988,017 | 10/1976 | Kyhl . | |
| 4,030,722 | 6/1977 | Irvine et al. . | |
| 4,083,555 | 4/1978 | Irvine et al. . | |
| 4,143,981 | 3/1979 | Hansen et al. . | |
| 4,171,130 | 10/1979 | Jeschke et al. . | |
| 4,193,590 | 3/1980 | Mongagnino . | |
| 4,395,032 | 7/1983 | Hipp, Jr. . | |
| 4,669,716 | 6/1987 | VanderSyde et al. . | |
| 4,691,912 | 9/1987 | Gillman . | |
| 4,723,773 | 2/1988 | Westover et al. . | |
| 4,753,432 | 7/1988 | Freeman . | |

FOREIGN PATENT DOCUMENTS

| | | | |
|---|---|---|---|
| 183445 | 9/1985 | Japan | 271/122 |

*Primary Examiner*—H. Grant Skaggs

*Attorney, Agent, or Firm*—Charles G. Parks, Jr.; David E. Pitchenik; Melvin J. Scolnick

[57] ABSTRACT

Singulating apparatus for singulating mail pieces of varying sizes and thickness comprises reversely-driven belts mounted in a four-bar linkage that pivots upwardly to allow bottom most mail pieces through while driving backward overlying mail pieces.

14 Claims, 4 Drawing Sheets

Fig. 1.
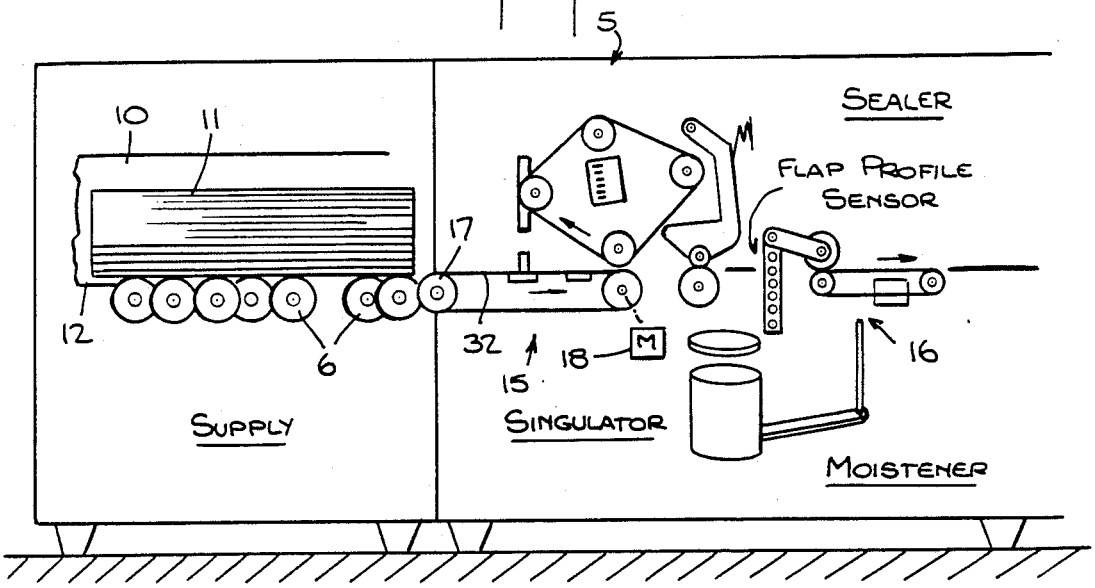
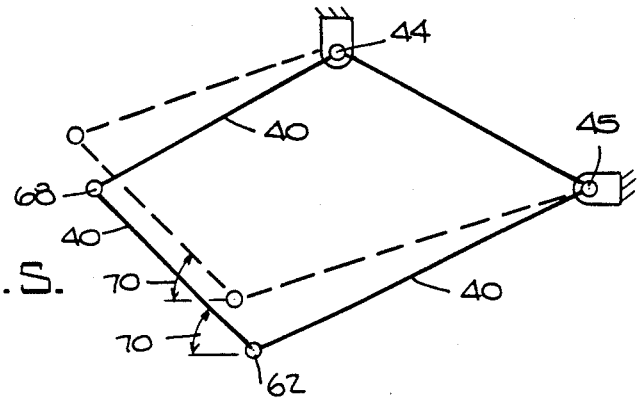
Fig. 5.
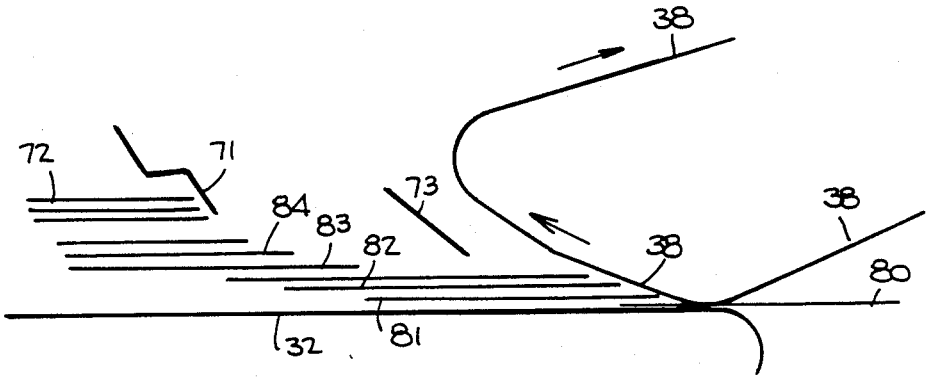
Fig. 6.

MAIL SINGULATING APPARATUS

FIELD OF THE INVENTION

This invention relates to singulating apparatus, and in particular to apparatus for repeatedly removing an individual article from a stack of articles for serial processing of the removed articles.

BACKGROUND OF THE INVENTION

State of the art mailing machines can perform such automatic functions as handling mail of different sizes and thicknesses, envelope sealing, mail weighing, mail stamping, and mail sorting. The typical processing sequence starts at the front end of the machine where the main is stacked. The stacked mail is then registered against a reference wall of the machine and the next step in the process is to remove individual mail pieces from the bottom of the stack and thereafter process those individual mail pieces through the various modules of the machine. This process is called singulation, and the apparatus involved a singulator. Many such devices or apparatus are well known in the art, but suffer from one or more of the following shortcomings. In some instances, singulators are incapable of handling mail pieces such as envelopes of varying thickness. In other instances, the known singulators are incapable of handling flapped and unflapped mail. In still other instances, the known singulators are incapable of processing stuffed envelopes at a fast enough rate.

SUMMARY OF THE INVENTION

An object for the invention is an improved singulator mechanism especially adapted for processing mixed mail.

Another object of the invention is a singulator mechanism capable of separating individual mail pieces from a stack of mail pieces at very high speed.

Still another object of the invention is a singulator mechanism for handling mail of varying thickness, ranging from an air mail envelope with a single insert all the way up to stuffed envelopes having a thickness of as much as three-quarters inches.

These and other objects and advantages of the invention as will be hereinafter described are achieved with a singulator apparatus comprising a forward driving mechanism located below the stack of envelopes in combination with a reversely driven mechanism located above the forward driving mechanism and cooperating therewith to push back any overlapping mail pieces and allow only a single envelope within a range of thicknesses to be advanced along the main flow path of the machine.

A preferred embodiment of the invention comprises a reversely driven mechanism employing a four-bar linkage forming a rhombus shaped mechanism provided with pulleys located at the rhombus corners. One or more belts rotate around the corner pulleys. The handling of mail of varying thickness is achieved by the rhombus deforming while maintaining its outer circumference.

SUMMARY OF DRAWINGS

The invention will now be described in greater detail in connection with an exemplary embodiment, taken in conjunction with the accompanying drawings wherein:

FIG. 1 is a schematic view of the front end of a mail handling machine employing one form of singulator in accordance with the invention;

FIG. 5 is a kinematic view of the four-bar linkage used in the singulator of FIG. 1;

FIG. 6 is a side schematic view illustrating the singulating action.

One form of singulator in accordance with the invention comprises forward drive and reverse drive subsystems, located between an upstream hopper which stacks the mixed mail and registers same against a reference wall of the machine, and a takeaway nip which moves the singulated mail downstream for further processing within the mail handling machine. FIG. 1 illustrates schematically the front end of the machine comprising a hopper 10 holding a stack 11 of registered amil on a deck 12 of a mailing machine designated 5. A forward-drive mechanism 6 mounted below the deck 12 moves the stack downstream (to the right in FIG. 1) toward the singulator section, designated 15. Following singulation, the unsealed mail has the profile of its flap generated, and information based on the profile is fed via a computer to a moistener which wets the flap blue line which is then sealed.

Figure 2:
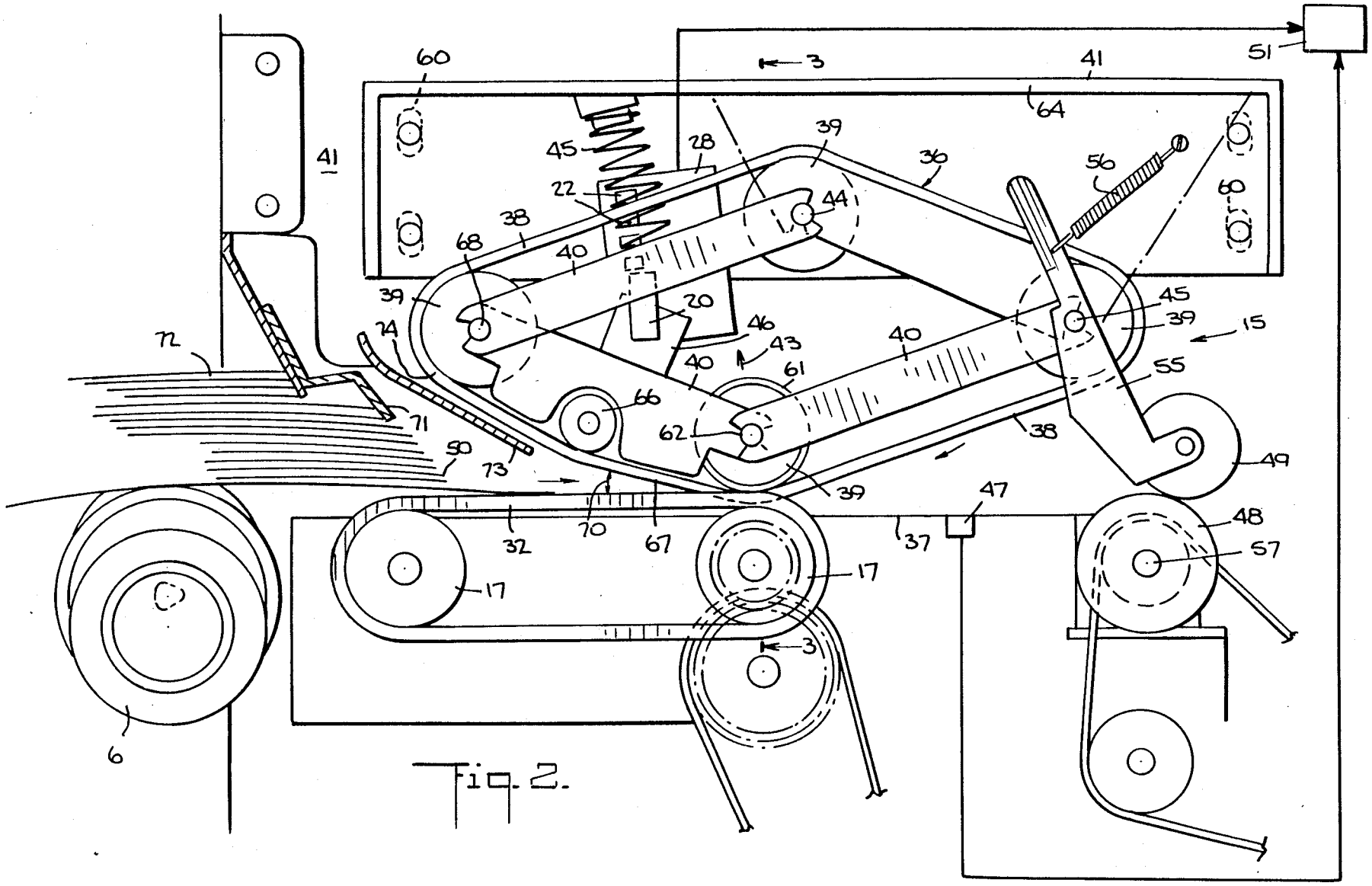
FIG. 2 is a detailed side view of the singulator illustrated in FIG. 1.

In this embodiment, the forward-drive mechanism for the singulator is one or more belts 32 mounted on and for rotation with end pulleys 17 driven by a suitable drive motor 18. The belts 32 protrude through openings in the deck 12 and on which the envelope stack rests. Just before entering the singulation area, a baffle plate mounted on the machine bed forms a restricted gap which allows only one or more than approximately three-quarters inches through and into the singulator section where the envelopes are then picked up and driven forward by the forward drive mechanism 17, 18, 32.

FIG. 2 shows in more detail a side view of one form of singulator in accordance with the invention. It preferably comprises a four-bar linkage mechanism 36 which is pivoted on the machine frame. The forward drive for the mail pieces is supplied by three belts 32 which are mounted on the machine desk 37. The four-bar linkage 36 comprises one or more reversely-driven belts 38 rotating around pulleys 39 located at the corners of a rhombus formed by linkages 40. The rhombus is anchored at pulley shafts 44, 45 for pivotable movement on a fixed support 41 extending up from the machine frame. A compression spring 45 whose upper end is fixed to the frame biases the singulator 36 downward and applies a load onto the mail which it is helping to singulate. The reversely-driven belts 38 are interdigitated with the forward driving belts 32.

Before explaining in greater detail the operation of the singulating mechanism, it will be helpful to briefly explain first the operation and relation of the singulator to a mail thickness measuring sensor with which it cooperates. In the singulating operation, if more than one mail piece or overlapped mail pieces enter the zone between the reversely-driven belts 38 and the forwardly-driven belts 32, while the bottom mail pieces are driven forward to the right, any overlapping mail pieces are driven backward. I this process, the bottom mail piece is driven under the singulator nip, the lowermost portion of the reversely-driven belts 38, causing an upwards push on the mechanism. The rhombus 36 deforms to allow mail pieces of varying thickness to pass under it while maintaining its outer circumference. Thus, the rhombus 36 acts as a follower that moves upward in the direction indicated by arrow 43 a distance proportional to the mail thickness. The mail thickness sensor, as described in copending application, Ser. No. 291,094, comprises a magnet array 20, which is fixed by plate 46 to the lower linkage bar 40, and thus moves upward the same proportional distance. A Hall-effect detector array 22 for the magnet array 20 is mounted on a printed circuit board 28, which in turn is mounted on the fixed support 41. An optical sensor 47 is mounted in the deck, here designated 37, and functions to detect the leading edge of the mail piece. When detected, the sensor shuts down the forward and reverse drives for an instant. Thus, the singulator upward motion steps. At that point, the thickness detector output to a register (not shown) stabilizes, and a computer 51 also signaled by the sensor 47, polls the register, retrieves a binary coded number stored therein, and in turn stores it in an internal register. After a fixed time delay, the drive mechanisms are restarted, and the individual mail piece continues its journey through the machine. The thickness measurement is used as a measure of weight by the computer to control the velocity of the mail piece.

The singulator mechanism in this environment, especially with high speed processing, e.g., up to 4 mail pieces per second, must operate reliably and effectively. If more than one piece of mail at a time is sent downstream, the machine may jam or funds will be lost. Moreover, the singulator must be able to singulate mail pieces as small as No. 6 envelopes and as large as No. 15 envelopes, both sealed and unsealed, and with thicknesses ranging from thin airmail envelopes with a single thin insert, up to about ¾ of an inch. Prior art singulators, evidenced by commonly-owned patent No. 4,083,535; and U.S. Pat. Nos. 3,831,928 and 4,573,673 will not prove satisfactory to the task of singulating this wide range of envelope sizes and thicknesses. Moreover, for the reasons given in the copending application, Ser. No. 291,094, it is important to determine envelope thickness, and thus indirectly weight, as early as possible, in order to construct a proper velocity profile for each envelope as it proceeds through the machine, because only in this way will it be possible to obtain high mail throughput.

Among the features of the singulator of the invention are the four-bar linkage for the reversely-driven belts, the provision of feed-control structure preceding the singulator, the interdigitating of the forward and reverse drive belts, and others, which contribute to producing a machine not only capable of handling the large variety of mixed mail at high speeds, but also of a relatively small size with a small foot print allowing it to be mounted on an ordinary table.

Some of the features are further explained in greater detail below.

Figure 3:
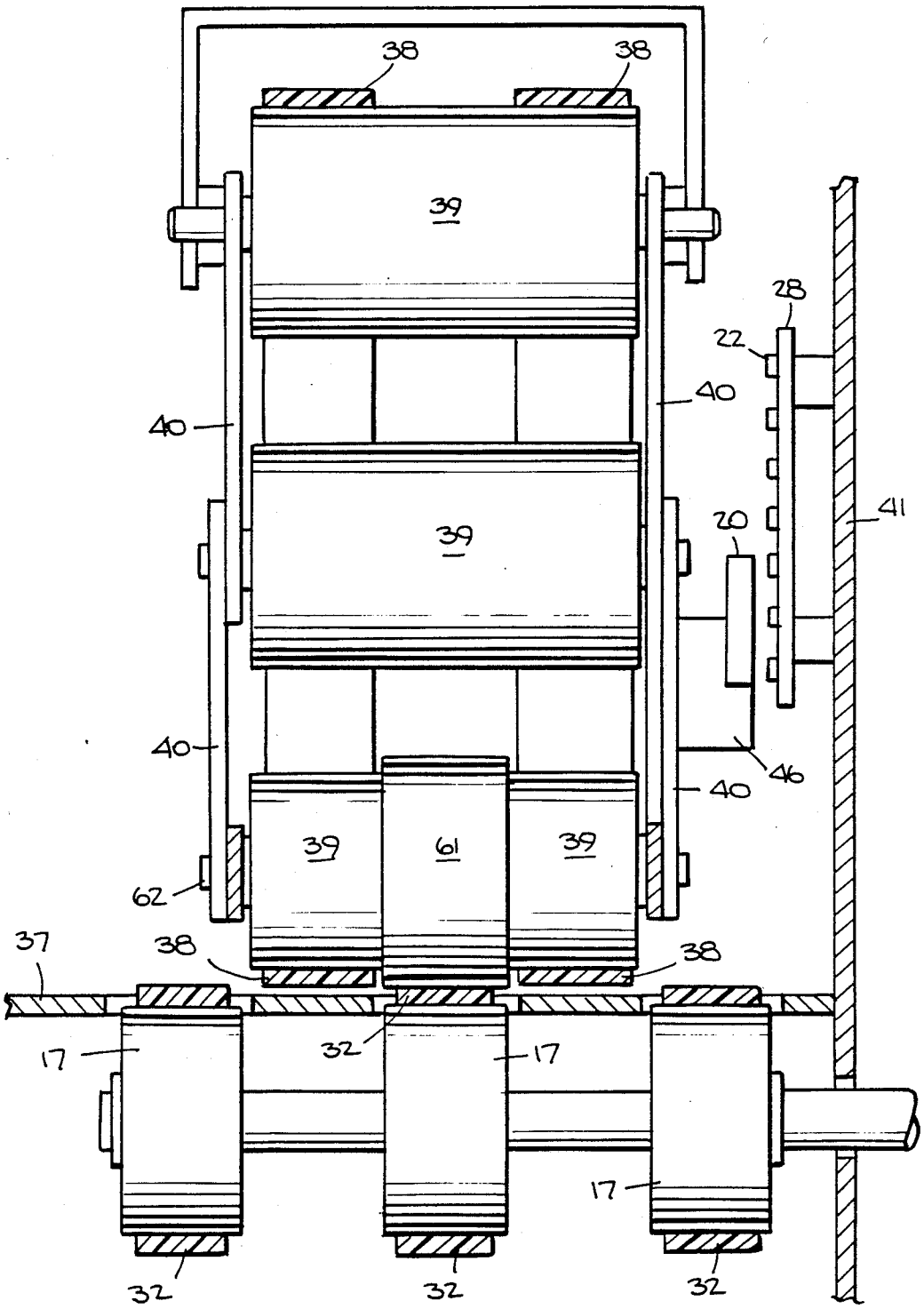
FIG. 3 is a cross-sectional view along the line 3—3 of FIG. 2.
Figure 4:
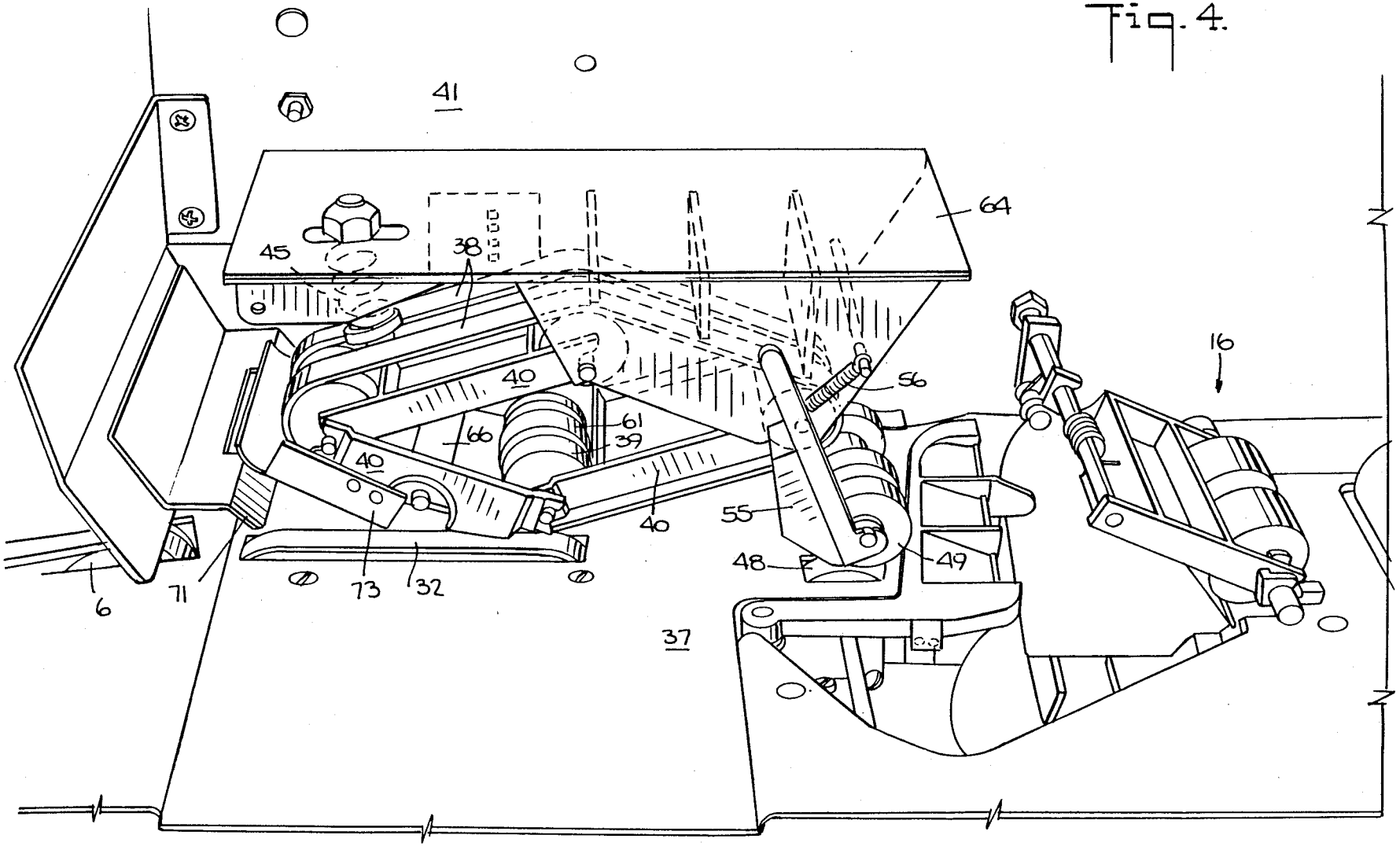
FIG. 4 is a perspective view from the top showing part of the downstream module of the machine.

In the preferred embodiment (see FIG. 3), the singulator forward drive mechanism comprises three belts 32, though it will be understood that fewer or more belts can be employed if desired. As an example, which is not intended to be limiting, the belts may be each about ⅜ inch wide by ⅛ thick and run on 1 inch diameter flanged pulleys 17 with a center distance of about 3.8 inches. The frictional material of the belts (i.e. the material that contacts the mail piece) is preferably a high friction material, such as, for example, natural rubber with a coefficient of friction on paper of 0.17–2.0. The belts 32 are semi-elastic so that they can be stretched slightly to assemble and they normalize their tension to approximately 4 pounds per belts. This feature of the belts precludes the need for a belt tensioner. The belts may have grooves (not shown) regularly spaced on their surface to enhance mail drive as well as act as wear indicators. When the grooves disappear it is an indication to the operator to replace the belts.

Downstream of the singulator 15 are provided takeaway means in the form of driven rollers 38 mounted in the deck, and idler 49, for removing individual mail pieces and maintaining successive mail pieces spaced a desired distance apart. The idler 49 is mounted on an arm 55 pivotably mounted on the shaft 45, which is biased into contact with the drive rollers 48 by a tension spring 56. The rollers 48, 49 rotate at a surface speed that is at least approximately 5 percent faster than the forward belts 32 so that they take away the mail piece that it is being pressed down onto them by the pressure arm 55 and thereby create a gap between the trailing edge of that mail piece and the leading edge of the subsequent mail piece. This gap is desirable for the proper operation of on-demand feeding of the mail. This differential in speed could be increased to approximately 25 percent by slowing the belts 32 to ensure more reliable singulation. It is preferred however to minimize the speed differential so that the error in tracking mail piece position, which becomes important later on in the mail processing, would be acceptable.

In the preferred embodiment, there are three takeaway rollers 48, but only the outer two of them actually drive the mail. The middle takeaway roller (not shown) is an idler roll which is used for accurately tracking the position of the mail piece. This is desirable because each mail piece will move at different speeds depending on how much it may slip on both the drive belts and the takeaway rollers, which speeds generally will be a function of its length, weight and coefficient of friction. Therefore, knowing how fast each belt or roller is going by reading an encoder on the motor driving same will not necessarily establish how fast the mail piece is actually moving. The idler takeaway roller, however, will be driven directly by the mail piece and it in turn can be used to drive a magnetically encoded wheel (not shown). By reading the pulses from this passive encoder, the mail piece can be tracked more accurately.

The drive train for both the forward drive belts 32 and the takeaway rollers 48 is preferably as follows. A dc servo controlled motor (not shown) is used to drive the takeaway shaft 57 on which the two outer rollers are mounted through a helical gear train with an overall ratio of about 1.5. The same motor also drives the forward belts 32 though another helical gear train. Since the takeaway rollers in the preferred embodiment have a diameter of about 1.2 inch, one revolution of the motor yields about 2 inches of surface travel. The effective belt speed is equivalent to the surface speed of the one inch diameter pulley on which it rides. This is because, although the mail rests on the outermost surface of the belt, it is traveling at the same speed as the inner surface between the belt pulleys. As the belt bends around the pulley the outer surface stretches and therefore goes faster, but the mail piece is then not longer in contact with the belt. So one revolution of the motor yields about 1.9 inches of surface travel. This is approximately 15% slower than the takeaway roller surface speed. This speed difference acting over the about 3.3 inches between the singulation nip and the takeaway nip produces a gap between adjacent mail pieces in the main flow path of about 0.15 inch.

The takeaway rollers 48 turn at 110 inches per second peak speed in order to meet the desired throughput of four mail pieces per second for the entire machine. This speed is adjusted however for mail thickness.

The reverse drive mechanism 36 of the singulator 15 is comprised of three basic parts: a four-bar linkage 40, a spring loaded 45 arm, which bears on the top movable link 40, and its drive train. The four-bar linkage 40 is the main part of the reverse belt mechanism. Two reverse belts 38 are rotated around pulleys 39 located at the corners of the rhombus formed by the linkages. During operation, the rhombus deforms to allow mail pieces of varying thickness to pass under it while maintaining its outer circumference. The compression spring 45 with a spring rate of about 0.6 lb/in applies a load onto the mail which it is helping to singulate. The load varies from approximately 0.75 lbs. initially to approximately 1 lb for a 0.75 inch thick mail piece. The reverse belts 38 hang from a horizontal extension 64 of the frame 41 mounted on the machine bed and are interdigitated with the forward drive belts 32 (see FIG. 3). In this way the two belt types cannot wear against each other. Furthermore, in order to prevent the reverse belts 38 from wearing against the deck surface, a height adjustment indicated by 60 is provided on the frame 41 that supports the four-bar linkage. This is used as a stop to prevent the reverse belts from resting on the deck but also as an interlace adjustment (with shims) for proper feeding and singulation. With excessive interlace, weak envelopes (e.g. air mail envelopes with one insert) may not be able to lift the four-bar linkage. If there is not sufficient interlace then there is an increased chance of multiple feeds. The adjustment at 60 allows the choice of the proper interlace.

In addition to the interlace adjustment mentioned above, another feature of the invention provides for optimum feeding performance of the forward drive without service or user adjustment required. This is achieved by providing an additional idler roller 61, mounted on the same shaft 62 of the lowermost rollers 39. This idler roller 61 rests on the forward center feed belt 32, setting the clearance height between the forward 32 and reverse feed belt 38. As the forward belt 32 wears, the idler roller 61 maintains the original clearance. This is important to satisfactory feeding, since, if the clearance is too small double feeds may result, whereas if too large, envelopes will not be efficiently driven forward. A suitable clearance for the example given above is about 0.035 inches.

The reverse belts 38 preferably are made of microcellular urethane molded onto a semi-elastic carrier. The microcellular urethane provides a coefficient of friction against paper of about 1. It is able to maintain this value very well because it wears evenly without glazing and paper dust tends to move into the open cells rather than coat the surface. The semi-elastic carrier enables the belts to run around the four-bar linkage without a tensioner.

The drive train for the reverse belt mechanism comprises a dc motor (not shown) with no servo control which drives the reverse belts through a helical gear train with an overall ratio of about 2.7 at an rpm to produce a belt surface speed of about 3 inches per second. For the purpose of ease of assembly of the reverse belt mechanism, the motor drives one of the shafts 44, 45 which passes from the back to the front of the rear wall 41 with a coupling (not shown) on the front side that meshes with a coupling on the belt pulley shaft.

An additional idler roller 66 is mounted on opposed links 40 and rides on the inside of the belts 38 and assists in absorbing the impact of the oncoming mail as it strikes and lifts the linkage.

One of the features of the invention is the four-bar linkage construction of the reverse drive. This mechanism offers the following advantages. It allows a constant speed belt or belts to be driven such that one narrow belt area is lowermost as shown at 67 and can be contacted to the mail piece. When moved upward by mail pieces of varying thicknesses, though the rhombus deforms, the overall belt length remains the same, which is a property of this four-bar linkage construction. Thus, the belt tension remains the same in all positions, and no separate or internal belt tensioner is necessary. In addition, the belts 38 can be driven if desired from the same motor that drives the forward belts 32, via a pulley which remains fixed to the frame support. This will simplify and reduce construction costs. Moreover, the four-bar linkage when pushed upwardly by mail pieces of varying thicknesses moves upwardly in a linear relationship to the mail thickness. This allows use of the magnetic field sensor which also reacts linearly to the magnet motion.

FIG. 5 shows a kinematic drawing of the linkage. The two fixed pivot points correspond to the shafts 44, 45. The links 40 connect to the movable lowermost shaft 62 and the leftmost movable shaft 68. The solid lines depict the plane linkage position with pivot 62 at its lowest position. The dashed lines show a second position in which pivot 62 has been moved upward by a mail piece. It will be noted that the movement of pivots 62 and 68 is slightly backward (opposite to the forward direction of the mail) as well as upward, due to anchoring of the rightmost and topmost pivot points.

An important factor is the angle indicated by 70 between the singulator belt 38 and the forward drive belt 32. This envelope receiving angle is important because it allows the singulator to handle thin as well as thick mail, in the embodiment described up to ¾" thick. The angle 70 for best results should be in the range of about 13°–16°, with 15° being preferred. It has been shown exaggerated in FIG. 5. With other mail thickness ranges, other angles may be necessary. An advantage of the four-bar linkage is that receiving angle 70 remains substantially constant as the rhombus deforms.

The supply drive typically pre-shingles the stacked mail as indicated at 50 in FIG. 2. In view of the geometry indicated, incoming mail to the singulator must remain below the height of the nearest pulley 39. For this purpose, a bracket 71 is mounted on the frame 41 and oriented as shown to block mail, indicated at 72, that is above a certain height equal to the gap between the lower edge of the bracket 71 and the top of the forward drive belt 32. For the example given above, this gap is chosen to be equal to the maximum envelope thickness, namely, ¾ inch. In addition, a guide plate 73, mounted to the lower left link 40, serves to help lift the singulator when thick mail pieces are present. For the dimensions given above, the height of the point 74 on the reverse belt 38 above the forward belt 32, with the four-bar linkage in its lowermost position, is about one inch. An incoming ¾ inch thick mail piece may thus impact the belt 38 at too high a point and not cause the linkage to lift. This would jam the machine. Instead, with guide 73 present, the thick mail piece which passes under bracket 71 first impacts guide 73 causing the linkage to lift, and will not pass on to the singulator nip until it can pass under the gap between the lowermost edge of the guide 73 and the drive belt 32.

In the typical operation of the singulator of the invention, multiple thin envelopes, pre-shingled, will be driven forward under both bracket 71 and guide 73 and impact the reversely driven belts 38. The tension provided by the spring 45, together with the friction coefficients of the belt drives, is chosen such that the four-bar linkage lifts to allow the lowermost envelope through, the reversely-driven belts driving the overlying envelopes backward. FIG. 6 illustrates schematically the action with 80 designating the bottom envelope feeding through, 81 the second from the bottom and 82-84 overlying pieces that passed under bracket 71. AS the process continues, the second from the bottom envelope 81 drops down to the drive belts 32, and in turn is driven forward while the shingled mail 82-84 overhead is held back. The faster surface speed of the takeaway nip ensures a reasonable spacing between the serial envelopes. The width of the linkage, provided by the multiple belts 38, singulates successfully small No. 6 envelopes as well as wide No. 15 envelopes.

While the invention has been described and illustrated in connection with preferred embodiments, many variations and modifications as will be evident to those skilled in thist art may be made therein without departing from the spirit of the invention, and the invention as set forth in the appended claims is thus not to be limited to the precise details of construction set forth above as such variation and modifications are intended to be included within the scope of the appended claims.

What is claimed is:

1. Singulator apparatus for separating individual articles from a stack of articles, comprising a deck, forwardly driving means for contracting the articles along one surface and moving the articles forwardly along a main path, said forwardly driving mechanism mounted to the deck to move said articles over the deck surface, a reversely driving mechanism for contacting the articles along another surface to drive backwards all but one of the articles, said reversely driving mechanism comprising a four-bar linkage arranged in the shape of a rhombus at least one belt rotatably mounted around the four-bar linkage, said four-bar linkage being mounted over said deck, and mens for causing the belt while reversely driven to maintain contact with the other surface of the articles.

2. Singulator apparatus as claimed in claim 1 wherein the contact maintaining means comprises means for biasing the reversely driving mechanism against the other surface of the articles.

3. Singulator apparatus as claimed in claim 1 wherein the forwardly driving mechanism comprises plural belts spaced transversely to the forward direction, and said belt on the reversely driving mechanism is positioned to lie opposite a space between the forwardly driving belts.

4. Singulator apparatus as claimed in claim 3 wherein the forwardly driving mechanism comprises three spaced belts, and the reversely driving mechanism comprises two spaced belts located over the two spaces between the forwardly driving belts.

5. Singulator apparatus as claimed in claim 4 wherein an idler roller is mounted on the reversely driving mechanism so as to lie over the contact the middle belt to determine the clearance between the forwardly driven and reversely driven belts.

6. Singulator apparatus as claimed in claim 1 wherein the forwardly driving mechanism comprises at least one belt that wears during use, and means connected to the reversely driving mechanism for maintaining a uniform clearance between the forwardly driving and reversely driving belts even as the forwardly driving belt wears.

7. Apparatus for processing mail pieces comprising means for supply multiple mixed mail pieces, a singulator for separating individual mail pieces, means for transporting mail pieces from the supplying means to the singulator, and means downstream of the singulator for taking away the singulated mail pieces, said singulator comprising a singulator nip formed between forwardly driving means and a reversely driven belt having a four-bar linkage arranged in the shape of a rhombus, and means for mounting of the reversely driven belt for movement relative to the forwardly driving means.

8. Apparatus for processing mail pieces as claimed in claim 7 wherein the four-bar linkage comprises four pivotable points, two of which are fixed and two of which are movable.

9. Apparatus for processing mail pieces as claimed in claim 8 wherein one of the fixed points is furthest from the supplying means.

10. Apparatus for processing mail pieces as claimed in claim 9 wherein the rhombus is configured such that the portion of the reversely driven belt facing the incoming mail forms a receiving angle of between about 13° and 16°.

11. Apparatus for processing mail pieces as claimed in claim 7 wherein the takeaway means comprises a takeaway nip whose downstream surface speed is at least 10% greater than the surface speed at the singulator nip.

12. Apparatus for processing mail pieces as claimed in claim 7 wherein the transporting means comprises a belt drive whose friction coefficient is greater than that of the reversely driven belt.

13. Apparatus for processing mail pieces as claimed in claim 7 further comprising means located between the supplying means and the singulator for blocking mail pieces above a certain height.

14. Apparatus for processing mail pieces as claimed in claim 7 in combination with mail thickness measuring means coupled to the reversely driven belt.

* * * * *